US006477823B1

(12) United States Patent
Kitterman et al.

(10) Patent No.: US 6,477,823 B1
(45) Date of Patent: Nov. 12, 2002

(54) CLOSURE AND CONTAINER SYSTEM FOR HOT FILLED CONTAINERS

(75) Inventors: Lawrence Kitterman, Brandenton; Mervyn Faris, Sarasota, both of FL (US)

(73) Assignee: Kerr Group, Inc., Lancaster, PA (US)

( * ) Notice: Subject to any disclaimer, the term of this patent is extended or adjusted under 35 U.S.C. 154(b) by 0 days.

(21) Appl. No.: 09/124,681

(22) Filed: Jul. 30, 1998

(51) Int. Cl.[7] ..... B65D 53/04

(52) U.S. Cl. ..... 53/485; 53/287; 53/331; 53/478; 53/488; 215/351; 215/DIG. 1; 215/344

(58) Field of Search ..... 53/478, 485, 487, 53/488, 287, 284, 331; 215/344, 351, DIG. 1

(56) References Cited

U.S. PATENT DOCUMENTS

| | | | | | |
|---|---|---|---|---|---|
| 2,380,396 | A | | 7/1945 | Berthold | 215/40 |
| 4,040,233 | A | * | 8/1977 | Valyi | 53/21 |
| 4,076,152 | A | | 2/1978 | Mumford | 222/545 |
| 4,078,688 | A | | 3/1978 | Nilsson et al. | 215/270 |
| 4,143,785 | A | | 3/1979 | Ferrell | 215/270 |
| 4,220,250 | A | | 9/1980 | Brownbill | 215/270 |
| 4,276,989 | A | | 7/1981 | Hicks | 215/270 |
| 4,322,011 | A | | 3/1982 | Mumford | 215/270 |
| 4,442,947 | A | * | 4/1984 | Banich, Sr. | 215/344 |
| 4,462,502 | A | | 7/1984 | Luenser et al. | 215/329 |
| 4,531,649 | A | * | 7/1985 | Shull | 215/232 |
| 4,531,650 | A | | 7/1985 | Friendship | 215/329 |
| 4,560,077 | A | * | 12/1985 | Dutt | 215/307 |
| 4,566,603 | A | * | 1/1986 | Moore | 215/329 |
| 4,574,966 | A | | 3/1986 | Sandhaus | 215/270 |
| 4,598,835 | A | * | 7/1986 | Brownbill | 215/307 |
| 4,629,083 | A | | 12/1986 | Druitt | 215/256 |
| 4,640,428 | A | | 2/1987 | Chang | 215/270 |
| 4,658,976 | A | | 4/1987 | Pohlenz | 215/252 |
| 4,714,167 | A | | 12/1987 | Sandhaus | 215/270 |
| 4,721,221 | A | | 1/1988 | Barriac | 215/350 |
| 4,896,782 | A | | 1/1990 | Hawkins et al. | 215/329 |
| 5,062,538 | A | | 11/1991 | Ochs | 215/260 |
| 5,161,707 | A | | 11/1992 | Dutt et al. | 215/344 |
| 5,184,746 | A | | 2/1993 | Moore et al. | 220/256 |
| 5,285,913 | A | | 2/1994 | Morton | 215/349 |
| 5,415,306 | A | * | 5/1995 | Luch et al. | 215/256 |
| 5,421,470 | A | | 6/1995 | Dudzik | 215/350 |
| 5,762,219 | A | | 6/1998 | Parrinello | 215/351 |
| 5,878,794 | A | * | 3/1999 | Somers | 141/82 |

* cited by examiner

*Primary Examiner*—Allen Ostrager
*Assistant Examiner*—William Hong
(74) *Attorney, Agent, or Firm*—Kenyon & Kenyon

(57) ABSTRACT

A closure device for a plastic container includes a liner and a plastic closure. The liner is sealed to the neck of the bottle at the end face of the neck and along a portion of the outer surface of the neck. The plastic closure engages the liner to retain the liner against the neck during sealing and to seal the area between the liner and the closure top from liquids present during cooling of the container. The closure includes a top wall, an annular closure skirt depending from the top wall, an annular outer flexible seal depending from the top wall, and at least one annular pressure ring. The outer flexible seal retains an outer edge of the liner against the outer surface of the container neck and prevents ingress of liquids. The annular pressure ring engages the liner to retain the liner against the end face of the neck during sealing.

4 Claims, 2 Drawing Sheets

CLOSURE AND CONTAINER SYSTEM FOR HOT FILLED CONTAINERS

FIELD OF THE INVENTION

The present invention relates to container closures, and in particular to closures for use with containers which are hot filled, sealed, and exposed to moisture.

BACKGROUND INFORMATION

Many containers or packages, for example those filled with certain foods, are filled at elevated temperatures, or "hot filled." In the hot filling process, the product is to introduced to the container at a temperature which can kill bacteria in the product as well as bacteria on the interior surface of the container. In this manner, the food inside the container is sterilized without any pretreatment of the container, increasing manufacturing efficiency. After hot filling, containers may be capped and passed through a cooling bath to drop the temperature of the product. The cooling bath can be, for example, a submersion tank filled with water or a cooling tunnel housing a water spray.

Glass containers and metal closures have been employed in the hot filling of a variety of products. When these are used, the interior top surface of the metal closure may be coated with a closure lining compound such as plastisol. The process of cooling the heated product tends to reduce the pressure inside the container, creating a partial vacuum effect. This vacuum retains the metal closure tightly against the glass container neck, and the lining compound then effectively seals the contents of the container from spoilage. The lining compound also prevents water from migrating into the container, which may be drawn into the container from the cooling bath due to the vacuum created as the container and contents are cooled. While glass containers are effective, however, they are much more expensive than equivalent plastic containers, and are of course relatively fragile. Similarly, metal closures are relatively expensive and can rust or otherwise degrade.

Accordingly, it is desirable to employ plastic containers and closures that may be hot-filled. However, when plastic containers and closures are employed, it is difficult to utilize a closure lining compound, because curing these compounds typically requires exposure to temperatures which would melt or otherwise degrade the plastics. As a result, a different method of sealing the product must be used. One alternative sealing mechanism is a liner, such as a foil liner, which is sealed to the face of a container neck. Sealing liners are especially advantageous when contents may be stored for long terms, for example while food products are shipped, stored, and displayed on shelves.

As noted above, the process of filling at elevated temperatures, sealing the container, and cooling the container tends to draw water under the closure top. Unlike the liner compound of a metal closure, however, which is bonded to the top wall of the closure, a foil liner is generally bonded to the container neck. As a result, the area between the foil liner and the top wall of the closure may be accessible to moisture. This arrangement may promote water migration between the inner surface of the top wall and the outer surface of the liner. The presence of water in this area is undesirable due to potential growth of bacteria and molds, which may occur over time as the product is shipped and stored. This growth may be particularly significant given that the cooling bath water is normally not purified.

In order to prevent water migration, some known closure systems provide a secondary liner to obstruct water, for example a liner of polyolefin foam or a compression molded gasket made from thermoplastic rubber. These types of closures rely on compression of the secondary system to prevent water ingress. The addition and compression of the secondary liner, however, require additional closure elements and additional manufacturing steps, adding to the cost of the closure. Moreover, to the extent that these materials are porous or absorbent, bacterial growth may nevertheless occur. The prior art has therefore not provided a plastic closure for use with hot-filled plastic containers that effectively prevents water migration and bacterial growth between a container liner and the inside surface of the closure.

SUMMARY OF THE INVENTION

The present invention provides a closure system for a plastic container, which includes a liner and a plastic closure. The liner can be, for example, induction sealed to the neck of a container at the end face of the neck and, for example, along an outer surface of the neck. The plastic closure may engage the liner to retain the liner against the neck during induction sealing and to seal the area between the liner and the closure top against migration of liquids. The closure preferably includes a closure top wall, an annular closure skirt depending from the top wall, an annular outer flexible seal depending from the top wall, and at least one annular pressure ring. The outer flexible seal can optionally retain an outer edge of the liner against the outer surface of the container neck and minimize ingress of liquids. The annular pressure ring may engage the liner to retain the liner against the end face of the neck during induction sealing and prior to removal of the closure.

DETAILED DESCRIPTION OF THE INVENTION

Figure 1:
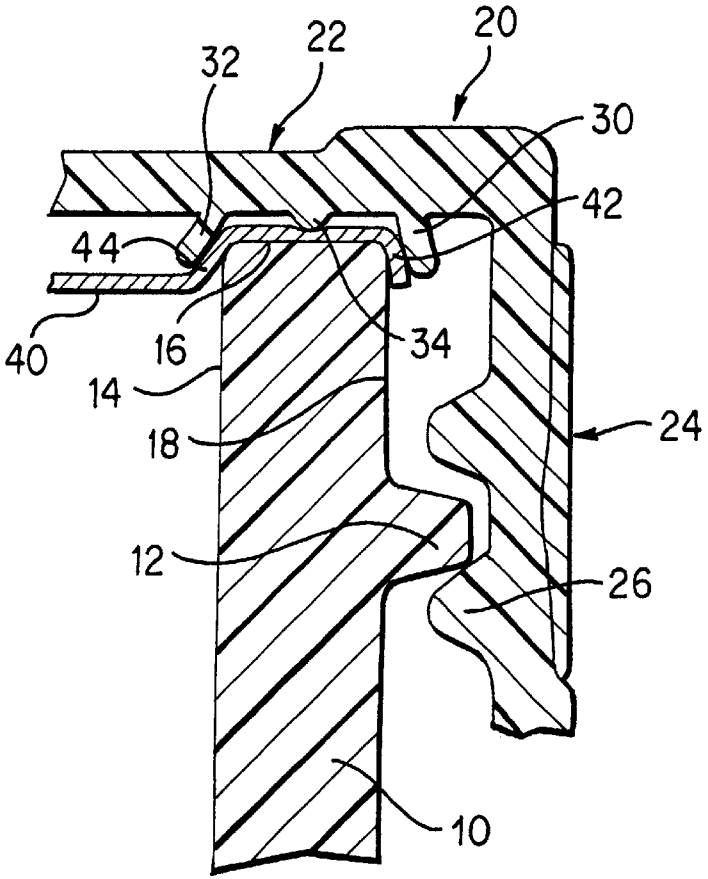
FIG. 1 is a cross-sectional view of an exemplary embodiment of a closure system according to the present invention.

FIG. 1 illustrates an exemplary embodiment of a closure system according to the present invention. In general, the closure system may include, for example, a plastic container with a plastic container neck 10, a plastic closure 20, and a liner 40. Preferably the container neck 10 includes at least one external thread 12, but any suitable type of engagement formation may be employed to retain the closure 20 on the container neck 10. The container neck 10 is also preferably cylindrical, but any suitable shape may be employed. In the exemplary embodiment of FIG. 1, the container neck 10 includes an inner neck surface 14, a neck end face 16, and an outer neck surface 18. In accordance with the present invention, the container neck 10 (and preferably the entire container) is advantageously made of plastic. While any suitable plastic may be used, the container is preferably made of polyethylene terephthalate (commonly referred to as "PET") or a high-density polyethylene. Another advantageous container construction is a multilayer barrier, which may include several layers of materials. Preferred materials for this type of container include those materials above and, for example, nylon or polypropylene. Preferably such containers are produced by either extrusion blow molding or injection stretch blow molding, although any suitable process may be used. The provision of a plastic container provides advantageous manufacturing and handling benefits, allowing for effective storage of the product with improved benefits over a glass container.

The closure system of the present invention includes a liner 40, which is capable of being induction sealed to the container neck 10. The liner 40 may be constructed of any suitable material, but preferably is a metal foil such as aluminum with a heat sealant facing, along with a backing. The backing may be, for example, polyester or polyolefin foam, but may also be the same material used for the container. The latter arrangement is particularly suitable for the induction sealing process, as induction sealing of like materials can form an excellent bond.

In the embodiment illustrated in FIG. 1, liner 40 is primarily sealed, for example, to neck end face 16. In addition, however, an annular outer ring 42 of the liner 40 is sealed to the outer neck surface 18. This phrasing ("sealed to the outer neck surface 18") includes configurations (like that of FIG. 1) in which the outer ring 42 is sealed, for example, to just an upper portion of outer neck surface 18. In addition, an annular inner ring 44 of the liner 40 may engage and, for example, be sealed to the inner neck surface 14. This phrasing likewise includes configurations in which the inner ring 44 engages only an upper portion of the inner neck surface 14. It should also be understood that outer ring 42 and inner ring 44 need not include any special construction or physical demarcation. Rather, outer and inner rings 42 and 44 are preferably of unitary construction with the remainder of liner 40, the rings 42 and 44 being designated and numbered herein for purposes of clarity only. Where sealing on the inner or outer neck surfaces 14 and 18 is desired, the liner 40 is preferably circular in shape with a diameter slightly greater than the diameter of the container neck.

FIG. 1 also illustrates a plastic closure 20 according to a first exemplary embodiment of a closure system according to the present invention. In this embodiment the closure 20 includes a closure top wall 22 and a closure skirt 24. The closure skirt 24 depends, for example, from the outer edge of top wall 22. Preferably top wall 22 is circular in shape and the closure skirt 24 is annular (i.e., substantially cylindrical) in shape. The skirt 24 includes, for example, one or more internal threads 26 that cooperate with the external thread 12 of the container neck 10. As noted above, any suitable formation may be provided to retain the closure 20 on the container neck 10, and the term "internal thread" 26 should be read to include these other formations.

Closure 20 includes at least two other formations which depend, for example, from closure top wall 22: an outer flexible seal 30 and at least one pressure ring 34. Annular pressure ring 34 may have a triangular or trapezoidal cross-section, and may assist the induction sealing of liner 40 to container neck 10. Generally, it is advantageous to maintain contact between the liner 40 and neck 10 during sealing. It is often difficult to achieve satisfactory contact, however, by engaging the liner 40 with the flat closure top wall 22, because the force from the top wall 22 is spread over the entire surface of, for example, neck end face 16. When heat is applied during induction sealing, the top wall 22 may deform upward and allow the liner 40 to shift upward. By including one or more annular pressure rings 34, the force applied by the top wall 22 may be concentrated over a much smaller surface area, thereby increasing the pressure applied to the liner 40. By applying such concentrated pressure, contact between the liner 40 and the container neck 10 is maintained, so that the liner 40 may not shift upward. Also, because the melting temperature of a solid decreases as the pressure applied to the solid increases, the concentrated pressure applied by pressure ring 34 lowers the melting point of the backing and the neck end face 16. Induction sealing of these elements therefore occurs at lower temperatures, providing manufacturing advantages.

While annular pressure ring 34 improves sealing, for example induction sealing, it often does not form an adequate seal between the closure 20 and the liner 40 after induction sealing. This inadequacy can result from the high temperatures associated with the induction sealing process. As the liner 40 and surrounding areas, including pressure ring 34, are heated, the pressure ring 34 can deform. Given the high upward pressure exerted on the lower edge of the pressure ring 34 by the neck end face 16 (through liner 40), the pressure ring 34 can deform upward and flatten out. As a result, pressure ring 34 can engage liner 40 imperfectly after induction sealing, and even small imperfections could permit water to penetrate the area between the liner 40 and the closure top wall 22 during cooling.

In accordance with the present invention, outer flexible seal 30 is provided to enhance the seal between the closure top 22 and the liner 40. Annular outer flexible seal 30 can assist during induction sealing of the liner 40 by retaining the outer ring 42 against the outer neck surface 18. However, outer flexible seal 30 does not unduly plastically deform during the sealing process. Rather, the tensile strength (i.e., "hoop strength") of the outer flexible seal 30 and. its flexibility allow the outer flexible seal 30 to maintain a seal against outer ring 42 and outer neck surface 18. This seal exists even after induction sealing and during cooling. Accordingly, outer flexible seal 30 prevents the migration of water into the area between the closure top 22 and the liner 40.

An annular inner flexible seal 32 may also be provided, as illustrated in FIG. 1. Inner flexible seal 32 contacts inner ring 44 to provide an additional seal against water migration. In one embodiment, inner flexible seal 32 may force the inner ring 44 against the inner neck surface so that the inner ring 44 may be sealed to inner neck surface, while in another embodiment the inner flexible seal 32 may simply contact the liner 40 to form a resilient seal between the two.

Preferably outer flexible seal 30 extends radially outwardly at an angle as it extends down from top wall 22. This outward angle helps, for example, in centering the closure 20 on the neck 10 as the closure 20 is applied. The outward angle also ensures, for example, a tight seal between the closure 20 and liner 40 and neck 10. Similarly, inner flexible seal 32 may extend radially inwardly at an angle as it extends down from top wall 22. This inward orientation provides the same advantages as the outward orientation of outer flexible seal 30. Preferably outer flexible seal 30 and inner flexible seal 32 are constructed at an angle approximately 10 to 45 ° from the vertical. Both seals 30 and 32 are preferably thin in cross-section as illustrated in FIG. 1, for example rectangular or otherwise oblong. Other configurations may be employed, however. For example, each could have a more triangular cross-section if greater rigidity were desired, or each could be constructed in the form of one or more annular "crab's claws."

Closure 20 may be constructed from any suitable type of plastic and may be produced using any suitable process. Preferably, however, closure 20 is constructed of polypropylene or high-density polyethylene. Normally it is not possible to construct both the backing of liner 40 and the closure 20 from the same type of material, because the two elements might then be sealed together during an induction sealing process. In this context, however, the closure 20 according to the present invention provides an additional advantage. Because the outer ring 42 of the liner 40 is depressed by outer flexible seal 30, outer ring 42 may not fold upward or otherwise errantly contact closure 20. The risk of accidental sealing of the liner 40 to the closure 20 is therefore minimized. Accordingly, a closure 20 according to the present invention is not limited in the type of materials used as are prior art closures, a feature that may provide particular advantages depending on the specifications required by a particular application.

Figure 2:
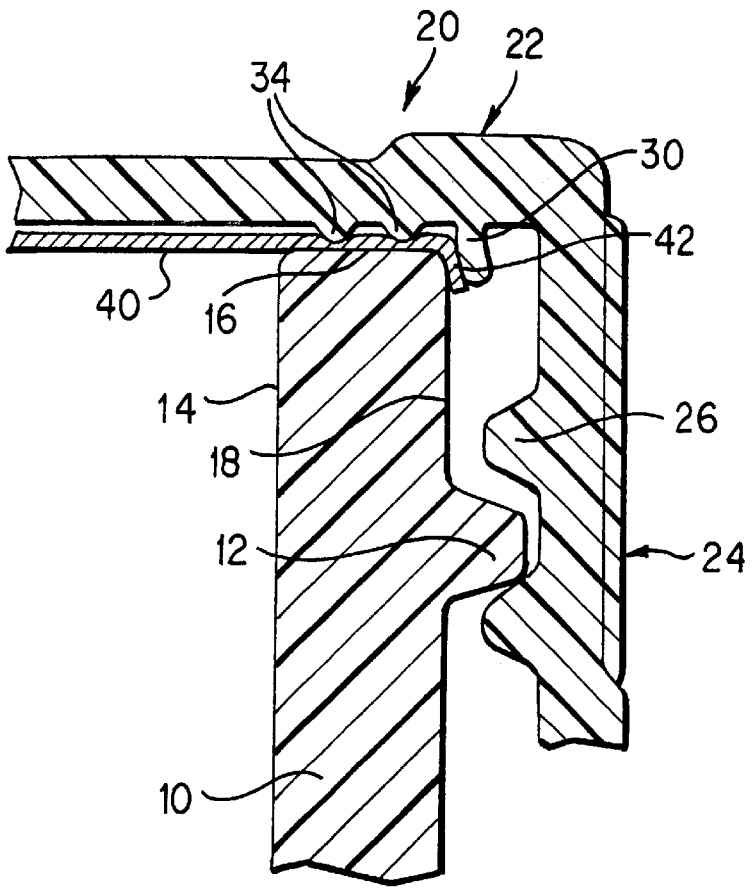
FIG. 2 is a cross-sectional view of a second exemplary embodiment of a closure system according to the present invention.

FIG. 2 illustrates a second exemplary embodiment of a closure system according to the present invention. In this embodiment, a plurality of pressure. rings 34 are, for example, provided for sealing. The multiple pressure rings 34 allow high pressures to be applied to the liner 40 by the top wall 22, and at the same time apply the pressure to multiple areas of the liner 40 where it engages the neck end face 16. The exemplary embodiment illustrated in FIG. 2 does not include an inner flexible seal 32, although such a seal optionally may be present.

Figure 3:
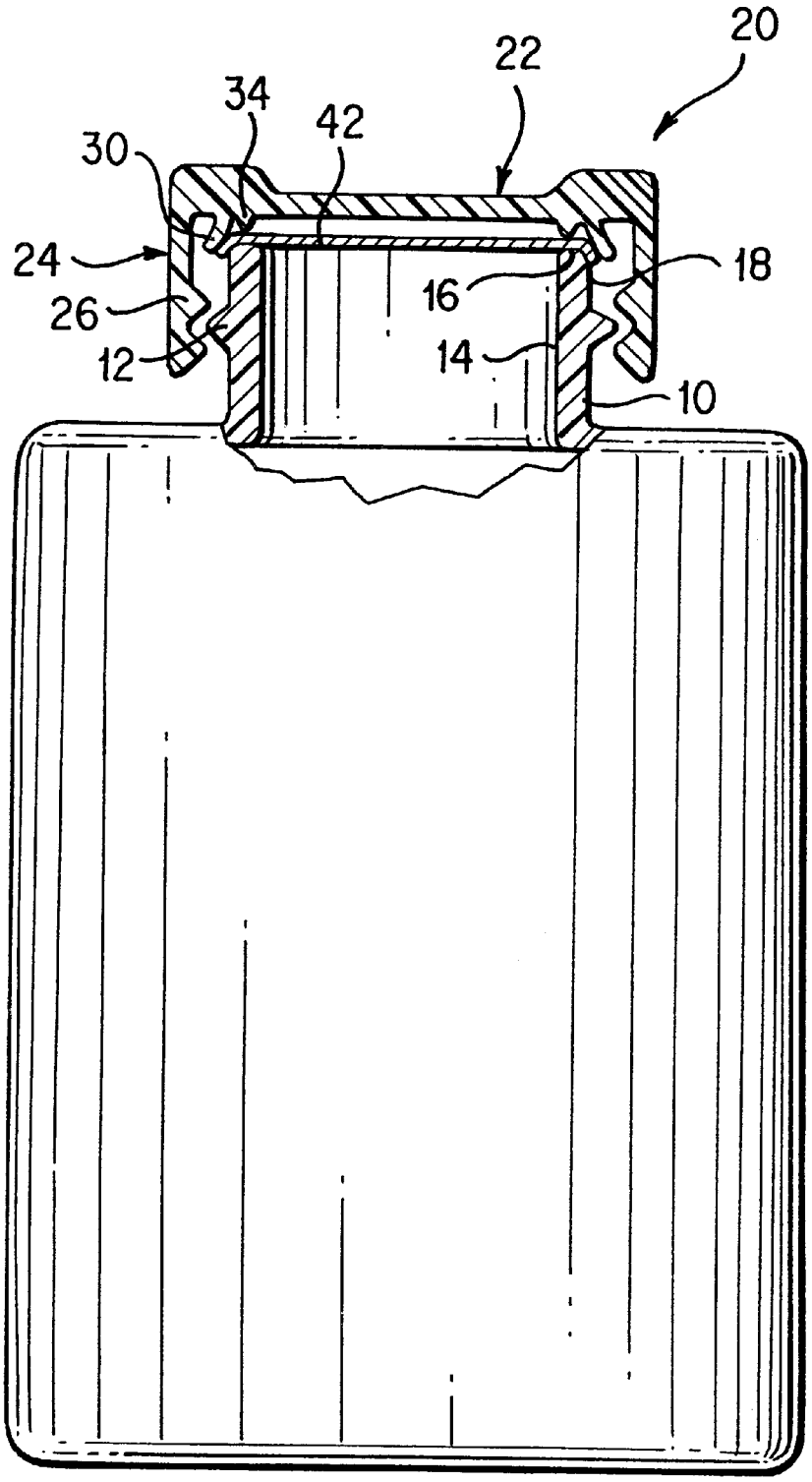
FIG. 3 is another cross-sectional view of a container and closure system according to the present invention.

FIG. 3 illustrates an embodiment of a container and closure 20 according to the present invention, the container including container neck 10. As noted above, a container according to the present invention may be constructed in any suitable manner and include any suitable materials.

A method of filling a package according to the present invention includes providing a plastic container, which preferably includes a neck 10 as described above. The container may then be filled with desired contents, the contents being at an elevated temperature, preferably high enough to sufficiently eliminate or kill bacteria on the inner surface of the container. A liner, such as liner 40 described above, may be provided on the end face 16 of the container neck 10. A plastic closure, such as closure 20 described above, may be placed over the liner 40 and neck 10. The liner 40 may then be sealed, for example induction sealed, to the container neck 10. Then, the container and contents may be cooled. Preferably, the cooling includes placing the container in a water bath or exposing the container to a cooling shower.

While not shown in the Figures, any suitable tamper indicating mechanism may be employed in conjunction with the present invention. For example, the tamper indicating mechanism described in U.S. Pat. No. 4,595,547 or co-pending U.S. Pat. application Ser. No. 09/078,646, entitled "Tamper Indicating Closure" (both of which are expressly incorporated herein by reference) may be provided. Similarly, any suitable child-resistant feature may be included, such as the child-resistant mechanism described in U.S. Pat. No. 5,280,842, U.S. Pat. No. 5,671,853, or co-pending U.S. Pat. application Ser. No. 09/078,643, entitled "Child-Resistant Closure and Container with Tamper Indication" (all of which are expressly incorporated herein by reference).

The device according to the present invention has been described with respect to several exemplary embodiments. It can be understood, however, that there are other variations of the above-described embodiments which will be apparent to those skilled in the art, even where elements have not explicitly been designated as exemplary. For example, a plurality of pressure rings 34 may be provided with the embodiment of FIG. 1, rather than a single pressure ring 34. In addition, the closure 20 may include other formations, such as external, ridges on the skirt 24. that facilitate gripping of the closure 20 by the user. It is understood that these and other modifications are within the teaching of the present invention, which is to be defined by the claims appended hereto.

What is claimed is:

1. A method of providing a container with contents, the method comprising:

(a) providing a plastic container including a cylindrical neck, the neck having an inner neck surface, a neck end face, and an outer neck surface, the outer neck surface including at least one external thread;

(b) providing the container with contents, the contents being at an elevated temperature;

(c) providing a liner on a neck of the container;

(d) providing a plastic closure on the liner and container, the plastic closure comprising:

(i) a top wall;

(ii) an annular closure skirt depending from the top wall, the closure skirt having at least one internal thread cooperating with the external thread on the outer neck surface to retain the closure on the container;

(iii) an annular outer flexible seal depending from the top wall engaging the liner; and (iv) at least one annular pressure ring depending from the top wall, engaging the liner to retain the liner against the neck end face;

(e) sealing the liner to the container neck; and (f) cooling the container and contents by exposing the container to water.

2. The method according to claim 1, wherein the step of sealing comprises induction sealing the liner to the container neck.

3. The method according to claim 2, wherein the step of exposing to water includes submersing the container in a water bath.

4. The method according to claim 2, wherein the step of exposing to water includes exposing the container to a water shower.

* * * * *